United States Patent [19]

Lattner

[11] Patent Number: 4,916,890

[45] Date of Patent: Apr. 17, 1990

[54] APPARATUS FOR SUPPORTING A STOP MEMBER OF A TEXTILE RING SPINNING MACHINE

[75] Inventor: Manfred Lattner, Ebersbach-Sulpach, Fed. Rep. of Germany

[73] Assignee: Zinser Textilmaschinen GmbH, Fed. Rep. of Germany

[21] Appl. No.: 357,339

[22] Filed: May 26, 1989

[30] Foreign Application Priority Data

May 26, 1988 [DE] Fed. Rep. of Germany ..... 3817891

[51] Int. Cl.[4] ..... D01H 13/16; D01H 13/14

[52] U.S. Cl. ..... 57/84; 19/0.25; 57/86; 57/87

[58] Field of Search ..... 57/78, 80, 81, 84, 86, 57/87; 19/0.25, 236, 244

[56] References Cited

U.S. PATENT DOCUMENTS

| | | | |
|---|---|---|---|
| 4,501,114 | 2/1985 | von Ronal-Horvath et al. | 57/81 |
| 4,519,199 | 5/1985 | Barauke | 57/87 |
| 4,630,434 | 12/1986 | Hartmannsgruber et al. | 57/86 X |
| 4,644,609 | 2/1987 | Lattner | 57/87 X |
| 4,683,712 | 8/1987 | Peters | 57/87 X |
| 4,727,713 | 3/1988 | Konig et al. | 57/84 |
| 4,763,467 | 8/1988 | Nickolay et al. | 57/86 X |

FOREIGN PATENT DOCUMENTS

| | | |
|---|---|---|
| 3532541 | 3/1987 | Fed. Rep. of Germany . |
| 3606609 | 9/1987 | Fed. Rep. of Germany . |

*Primary Examiner*—John Petrakes

*Attorney, Agent, or Firm*—Shefte, Pinckney & Sawyer

[57] ABSTRACT

An apparatus for supporting a stop member of a stop motion device of a textile ring spinning machine is provided. The apparatus includes a carriage having a cam portion for removably receiving and manipulating the projecting cam follower portion of the stop member, a device for reciprocating the carriage and a device for releasably positioning the carriage on the reciprocating device in a predetermined position. The carriage is disengagable from the positioning device for movement therefrom sufficiently to permit removal and replacement of the stop member from the carriage and is reengagable with the positioning device for positioning the carriage in its predetermined position. Preferably, the carriage and the positioning device each includes cooperatively configured portions for releasable interengagement with one another to position the carriage in its predetermined position.

24 Claims, 2 Drawing Sheets

FIG. 6
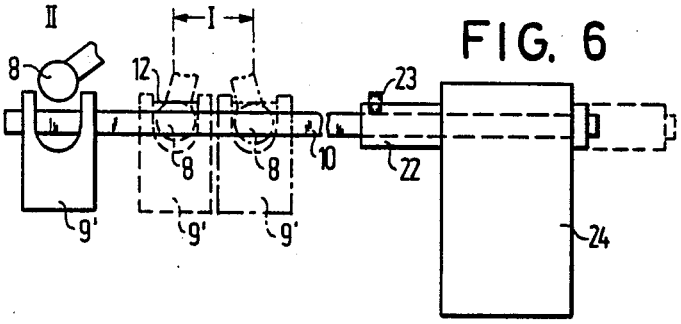
FIG. 7
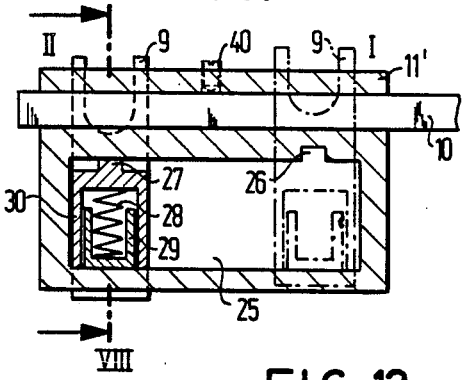
FIG. 8
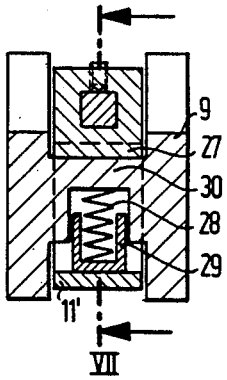
FIG. 12
FIG. 11
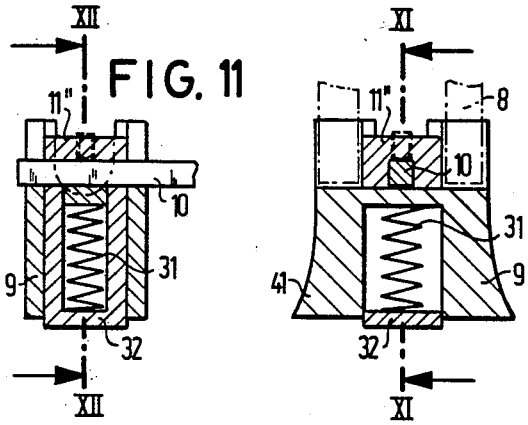
FIG. 9
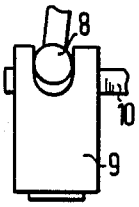
FIG. 10
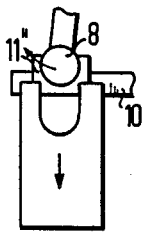
FIG. 13
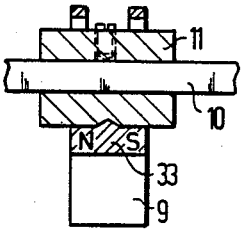
FIG. 14
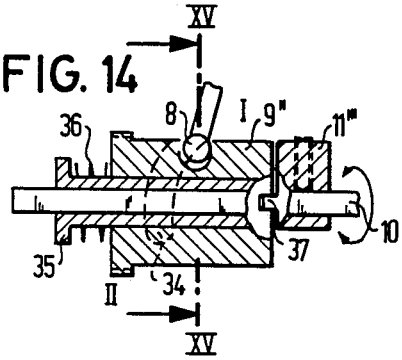
FIG.15
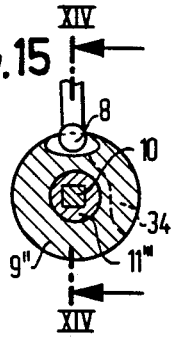

APPARATUS FOR SUPPORTING A STOP MEMBER OF A TEXTILE RING SPINNING MACHINE

BACKGROUND OF THE INVENTION

The present invention relates to an apparatus for supporting a stop member of a stop motion device of a textile ring spinning machine and, more particularly, to an apparatus for supporting a stop member of the type having a leading tapered end insertable between opposed rollers of a drafting device of the ring spinning machine and having a projecting cam follower portion for manipulating the stop member.

One known stop motion device for stopping the motion of a textile ring spinning machine includes a stop member having a leading tapered end insertable between a drive roller and an opposed driven roller of a drafting device of the ring spinning machine to stop the rotation of the driven roller and the feed of roving through the drafting device. The stop member typically includes a projecting cam follower portion which is received in a cam portion of a device which reciprocates the stop member between an operating position in which the leading tapered end of the stop member is inserted between the opposed rollers and a non-operating position in which the leading tapered end of the stop member is retracted from between the opposed rollers of the drafting device. However, this known stop motion device requires relatively time consuming adjustment to reposition the stop member relative to the opposed rollers for reciprocation between its operating and non-operating positions whenever the stop member is assembled or replaced in position for operation. For example, the drafting device typically includes several other pairs of opposed rollers and, when the spacing between the pairs of rollers is adjusted, the stop member and the reciprocating device must be correspondingly adjusted. Also, in the event that the stop member needs to be removed and replaced, the cam portion of the reciprocating device must typically be moved relative to the remainder of the reciprocating device to a position sufficient to permit the projecting cam follower portion of the stop member to be released from the cam portion. Once the defective stop member is removed, the projecting cam follower portion of the new stop member must be inserted into the cam portion of the reciprocating device and the reciprocating device must then be returned to the predetermined position in which it supports the stop member relative to the opposed rollers for reciprocating movement of the stop member between its operating and non-operating positions. As can be understood, the effort in repositioning the stop member is relatively time-consuming and, thus, adds relatively significantly to the operating costs of the ring spinning machine.

SUMMARY OF THE INVENTION

Accordingly, the present invention provides an apparatus for supporting a stop member of a stop motion device of a textile ring spinning machine which permits the stop member to be easily and reliably moved between a supported position for reciprocation between its operating and non-operating positions relative to the opposed rollers and a position for removal and replacement of the stop member.

Briefly described, the present invention provides an apparatus for supporting a stop member of a stop motion device of a textile ring spinning machine, the stop member being of the type having a leading tapered end insertable between a drive roller and an opposed driven roller of a drafting device of the ring spinning machine to stop the rotation of the driven roller and the feed of roving through the drafting device and having a projecting cam follower portion. The apparatus includes a carriage having a cam portion for removably receiving and manipulating the projecting cam follower portion of the stop member. Means are provided for reciprocating the carriage between an operating position in which the stop member is in a roller and roving stopping position and a non-operating position in which the stop member is retracted from the stopping position. Also, means are provided for releasably positioning the carriage on the reciprocating means in a predetermined position. The carriage is disengagable from the positioning means for movement therefrom sufficiently to permit removal and replacement of the stop member from the carriage and is reengagable with the positioning means for positioning the carriage in the predetermined position.

Preferably, the carriage includes means for releasably engaging the positioning means to position the carriage in the predetermined position, and the carriage and the positioning means each include cooperatively configured portions for releasable interengagement with one another to position the carriage in the predetermined position.

According to one aspect of the present invention, one of the carriage and the positioning means includes a projection and the other of the carriage and the positioning means includes a recess engagable with the projection for positioning the carriage in the predetermined position. In one embodiment, the positioning means includes the projection and the carriage includes the recess. In another embodiment, the carriage includes the projection and the positioning means includes the recess.

According to a further aspect of the present invention, the carriage includes biasing means for releasably retaining the carriage in engagement with the positioning means. In one embodiment of the invention, the projection and the recess are disposed on one side of the positioning means and the biasing means is disposed on an opposite side of the positioning means. Preferably, the biasing means includes a plate adjacent the positioning means and a spring disposed between the plate and the carriage for biasing the plate toward the positioning means.

According to one embodiment of the present invention, the positioning means includes additional means for positioning the carriage at a position spaced from the predetermined position sufficient to permit removal and replacement of the stop member.

According to another embodiment of the present invention, the positioning means is adjustable to vary the predetermined position of the carriage. In one embodiment of the present invention, the reciprocating means includes a reciprocable shaft, the positioning means being securable to the shaft for reciprocation therewith, with the positioning means preferably adjustably secured to the shaft.

According to yet another aspect of the present invention, the positioning means includes means engagable with the carriage to prevent separation of the carriage from the positioning means.

In a further embodiment of the present invention, one of the carriage and the positioning means includes a slot and the other of the carriage and the positioning means includes a portion receivable in the slot to permit and guide relative movement of the carriage from the predetermined position. Preferably, the carriage and the positioning means each include a slot and the carriage and the positioning means are each movably received in the slot of the other. Preferably, the carriage includes biasing means for releasably retaining the carriage in engagement with the positioning means, and the positioning means is adjustable to vary the predetermined position of the carriage.

In another embodiment of the present invention, the reciprocating means includes a reciprocable shaft and a shaft support, the shaft being adjustably fixed to the shaft support for adjustably setting the predetermined position of the positioning means and the positioning means being integrally formed on the shaft.

In one form of the present invention, the carriage and the positioning means includes magnetic means for urging the carriage into engagement with the positioning means in the predetermined position.

In another preferred embodiment, the carriage is cylindrical and the cam portion is in the form of a slot on the surface of the cylindrical carriage extending as a portion of a spiral, and the carriage is oscillatable about its cylindrical axis to effect movement of the stop member between the operating and non-operating positions. Preferably, the carriage is axially movable sufficiently to permit removal and replacement of the stop member from the carriage. In this form, the positioning means preferably includes a shaft portion and the carriage includes an axial bore for receiving the shaft portion therein, the carriage being axially movable along the shaft portion sufficiently to permit removal and replacement of the stop member from the carriage. Preferably, the apparatus further includes biasing means for releasably retaining the carriage in engagement with the positioning means.

BRIEF DESCRIPTION OF THE DRAWINGS

FIG. 6 is a side elevational view of a second preferred embodiment of the apparatus of the present invention;

FIG. 7 is an enlarged vertical sectional view of a third embodiment of the apparatus of the present invention taken longitudinally through the carriage and positioning means;

FIG. 8 is a transverse vertical sectional view of the apparatus in FIG. 7, taken along lines VIII—VIII of FIG. 7;

FIG. 9 is a side elevational view of a fourth embodiment of the apparatus of the present invention, showing the carriage of the apparatus in its predetermined position;

FIG. 10 is a side elevational view of the fourth embodiment of the apparatus shown in FIG. 9, showing the carriage disengaged from the positioning means sufficiently to permit removal and replacement of the stop member;

FIG. 11 is an enlarged vertical sectional view of the fourth embodiment of the apparatus shown in FIG. 9 taken longitudinally through the carriage and the positioning means along line XI—XI in FIG. 12;

FIG. 12 is an enlarged transverse vertical sectional view of the apparatus shown in FIG. 11, taken along line XII—XII in FIG. 11;

FIG. 13 is a vertical sectional view of a fifth embodiment of the apparatus of the present invention taken longitudinally through the carriage and positioning means;

FIG. 14 is a vertical sectional view of a sixth embodiment of the apparatus of the present invention taken longitudinally through the carriage and positioning means; and FIG. 15 is a transverse vertical sectional view of the apparatus shown in FIG. 14, taken along line XV—XV thereof.

DETAILED DESCRIPTION OF THE PREFERRED EMBODIMENTS

Figure 1:
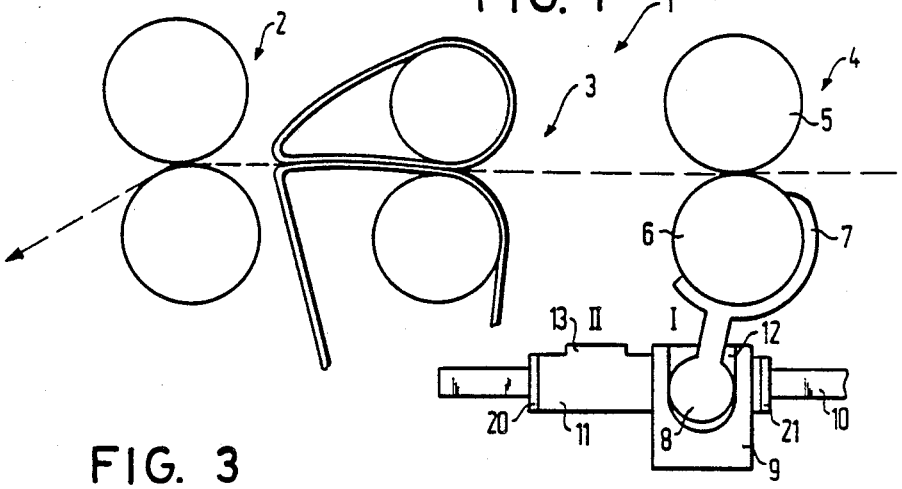
FIG. 1 is a side elevational view of one preferred embodiment of he apparatus of the present invention, showing the apparatus in its installed position relative to the drafting device of a textile ring spinning machine and showing the carriage of the apparatus in engagement with the positioning means of the apparatus at its predetermined position.
Figure 3:
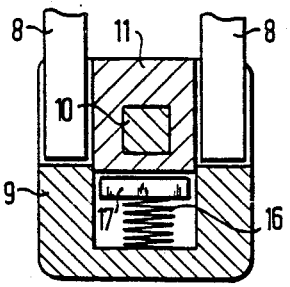
FIG. 3 is an enlarged vertical sectional view of the apparatus shown in FIG. 1, taken transversely through the carriage and the positioning means of the apparatus.

In FIGS. 1–5, one preferred embodiment of the apparatus of the present invention is illustrated. A drafting device 1 of a textile ring spinning machine has a pair of exit rollers 2, a pair of intermediate rollers 3 and a pair of feed rollers 4, the pairs of rollers being generally aligned with one another for feeding of roving along a feed path between the opposed rollers of each pair of rollers. The pair of feed rollers 4 includes an upper roller 5 and a lower roller 6. The lower roller 6 is partially circumferentially enclosed by a stop member 7 of a stop motion device.

The stop motion device is operable to stop the feed of roving through the drafting device 1 in the event of breaks and the like and includes, in addition to the stop member 7, the apparatus of the present invention for supporting the stop member. The stop member 7 is of the type having a leading tapered edge insertable between the upper roller 5 and the lower roller 6 to stop the rotation of the driven roller of the roller pair 4 and the feed of the roving through the drafting device 1. Additionally, the stop member 7 includes a pair of identically configured projecting cam follower portions 8, both portions being shown in FIGS. 3 and 5. Since the projecting cam follower portions 8 are identical and function in the same manner, only one of the projecting cam follower portions is described.

Figure 4:
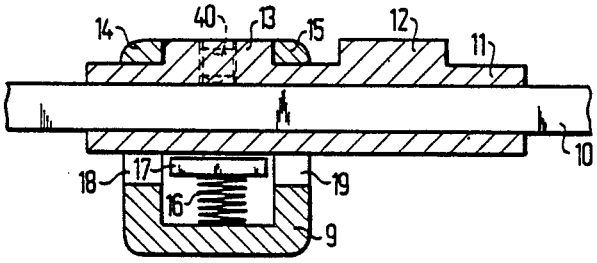
FIG. 4 is an enlarged vertical sectional view of the apparatus shown in FIG. 2, taken longitudinally through the carriage and the positioning means.
Figure 5:
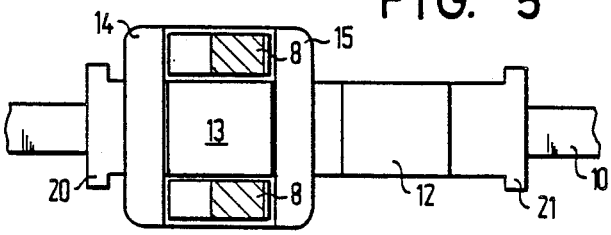
FIG. 5 is an enlarged horizontal sectional view of the apparatus shown in FIG. 2.

The apparatus of the present invention includes a carriage 9 having a cam portion for removably receiving and manipulating the projecting cam follower portion 8 of the stop member 7, a means for reciprocating the carriage 9 at a predetermined position 1 to alternately move the stop member into a roller and roving stopping position in which it stops the rotation of the driven roller and the feed of roving and a non-operating position in which the stop member 7 is retracted from the stopping position, the reciprocating means including a reciprocating shaft 10 with conventional means (not shown) for reciprocating the shaft 10, and means in the form of a block 11 for releasably positioning the carriage 9 on the shaft 10 of the reciprocating means. The carriage 9 is disengagable from the positioning block 11 for movement therefrom sufficiently to permit removal and replacement of the stop member 7 from the carriage 9 and is reengagable with the block 11 for positioning the carriage 9 in a predetermined position I. As best seen in FIG. 4, the positioning block 11 includes a generally square bore which receives therein the shaft 10, which is of generally square cross-sectional configuration, and the positioning block 11 includes a set screw 40 for adjustably securing the positioning block 11 to the shaft 10 for reciprocation therewith.

The positioning block 11 includes a first projection 12 projecting radially outwardly with respect to the shaft 10 for engagement by the carriage 9 to position the carriage in its predetermined position I. The positioning block 11 additionally includes a second projection 13, of generally the same configuration as the first projection 12, projecting radially outwardly with respect to the shaft 10 and axially spaced from the first projection 12. The second projection 13 engages the carriage 9 to position the carriage for removal and replacement of the stop member 7. Additionally, the positioning block 11 includes means engagable with the carriage 9 to prevent separation of the carriage from the positioning block, the separation preventing means being in the form of a shoulder 20 formed at one end of the positioning means 11 and a shoulder 21 formed at the other end of the positioning means 11.

The carriage 9 includes a pair of cross bars 14, 15 extending generally parallel to one another and defining therebetween a recess for receiving either the first projection 12 or the second projection 13, a hollow interior portion, a recess 18 extending below the cross bar 14 and opening into the hollow interior portion, a recess 19 formed below the cross bar 15 and opening into the hollow interior portion, and biasing means for releasably retaining the carriage in engagement with the projections on the positioning block. The recesses 18, 19 and the hollow interior portion define a receiving area for the positioning block 11 of sufficient size to permit relative movement of the carriage 9 with respect to the positioning block 11 to release the cross bars 14 and 15 from engagement with the projections 12 and 13 and to clear the projections 12 and 13 sufficient to permit shifting of the carriage on the positioning block 11. The biasing means includes a plate 17 adjacent the underside of the positioning block 11 and a spring 16 disposed between the plate 17 and an interior bottom surface of the hollow interior portion of the carriage 9 spaced from the block 11 for biasing the plate 17 toward the positioning block 11. The biasing means is disposed on an opposite side of the positioning block 11 than the projection 12 and the recess defined between the cross bars 14, 15 so that the cross bars 14, 15 are biased against the positioning block 11 as the spring 16 pushes the bottom surface of the hollow interior portion of the carriage 9 radially outwardly from the shaft 10.

The preferred embodiment of the apparatus illustrated in FIGS. 1–5 is operable as follows. To position the stop member 7 for reciprocation by the shaft 10 between its operating and non-operating positions, the carriage 9 is disposed in the predetermined position I by moving the carriage against the bias of the spring 16 sufficiently for the cross bars 14, 15 to clear the projections 12 and 13. Then, the carriage 9 is axially moved to position the recess defined between the cross bars 14, 15 in alignment with the projection 12 and the carriage 9 is released to allow the spring 16 to bias the carriage 9 relative to the positioning means 11 such that the projection 12 is received in the recess between the cross bars 14, 15. The carriage 9 is thus releasably retained by the biasing means in engagement with the projection 12 so that the carriage will move with the positioning block 11 as the positioning block is reciprocably moved by the shaft 10. Specifically, the shaft 10 is moved in one axial direction to cause the projecting cam follower portions 8 to move within the cam portions of the carriage 9 in a manner which brings the stop member 7 into its roller and roving stopping position. Upon axial movement of the shaft 10 in the opposite direction, the projecting cam follower portions 8 move within the cam portions of the carriage 9 to retract the stop member 7 from its stopping position to a non-operating position.

Figure 2:
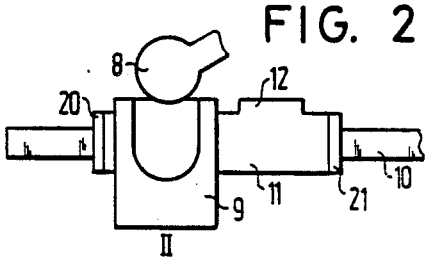
FIG. 2 is a side elevational view of the apparatus shown in FIG. 1, showing the carriage disengaged from the positioning means for removal of the stop member therefrom.

To disengage the carriage 9 from the projection 12 for movement therefrom sufficiently to permit removal and replacement of the stop member 7, the carriage 9 is moved against the bias of the spring 16 to move the cross bars 14, 15 sufficiently radially outwardly from the shaft 10 to clear the projection 12 and the carriage 9 is axially moved in the direction of the second projection 13 until the recess defined between the cross bars 14, 15 is aligned with the second projection 13. Then, the carriage 9 is released to allow the spring 16 to bias the carriage 9 relative to the positioning block 11 such that the second projection 13 is received in the recess defined between the cross bars 14, 15. As shown in FIG. 2, when the carriage 9 is positioned in the position 11 at which the second projection 13 is received between the cross bars 14, 15, the projecting cam follower portions 8 of the stop member 7 can be removed from the cam portions of the carriage 9 for removal of the stop member 7 from the carriage 9. The second projection 13 reliably retains the carriage 9 at the position 11 during the removal and replacement of the stop member 7. Once the stop member 7 has been replaced, the carriage 9 can be easily and accurately returned to its predetermined position I by simply aligning the recess between the cross bars 14, 15 with the first projection 12 and then engaging the first projection 12 therebetween. Thus, no re-adjustment of the carriage 9 is needed to accurately reposition the stop member 7 in position for reciprocation between its operating and non-operating positions.

In FIG. 6, a second embodiment of the apparatus of the present invention is illustrated. This apparatus includes a carriage 9' having a cam portion for removably receiving and manipulating the projecting cam follower portion 8 of the stop member 7, a reciprocating means, and a positioning means 12. The reciprocating means includes a reciprocable shaft 10 adjustably fixed to a sleeve 22 of a shaft support 24 by means of a set screw 23. The positioning means 12 is integrally formed on the shaft 10 in the identical shape as the first projection 12 described with respect to the embodiment illustrated in FIGS. 1–5 and the positioning means 12 serves the same positioning function as the first projection 12 of the positioning block 11 of that embodiment. The carriage 9' is engagable with the positioning means 12 to support the stop member 7 in its operating and non-operating positions, shown in broken lines in FIG. 6, when the carriage 9, is in its predetermined position I. The carriage 9′ is disengagable from the positioning means 12 and movable along the reciprocal shaft 10 sufficiently to permit removal and replacement of the stop member 7 in the same manner as the carriage 9 of the embodiment of FIGS. 1–5. The carriage 9′ includes a biasing means such as the spring 16 and the plate 17 described with respect to the embodiment illustrated in FIGS. 1–5, for biasing the carriage into engagement with the positioning means 12.

In FIGS. 7 and 8, a third preferred embodiment of the apparatus of the present invention is illustrated. This apparatus includes a positioning block 11, having a through bore having a square cross-section for receipt therein of a reciprocal shaft 10 of a means for reciprocating the positioning block 11′. The positioning block 11′ is adjustably securable to the shaft 10 by means of a set screw 40. Additionally, the positioning block 11′ includes a generally rectangular chamber 25 in its underside and a recess 26 formed on an upper surface of the chamber 25. The apparatus illustrated in FIGS. 7 and 8 additionally includes a carriage 9 having a cross piece 30 interconnecting a pair of spaced, parallel legs which define a recess therebetween. A projection 27 is formed on the top of the cross piece 30 and is compatibly configured with the recess 26 of the positioning block 11 for receipt therein. Additionally, the portion 30 includes a pair of cam portions for receiving the projecting cam follower portions 8 of the stop member 7 movably guided by the positioning block 11′. As best seen in FIG. 8, the recess defined between the spaced, parallel legs of the carriage 9 receives the bottom portion of the positioning block 11′ as the carriage 9 moves along the chamber 25. The positioning block 11′ includes a spring retainer 29 which retains a spring 28. The spring 28 pushes against the cross piece 30 on a side thereof opposite the projection 27 to urge the projection upwardly into engagement with the recess 26. Thus, the carriage 9 is biased into position with the positioning block 11, by operation of the spring 28 which urges the projection 27 into the recess 26, to releasably position the carriage 9 in the predetermined position I for proper positioning of the stop member for reciprocation with the positioning block between the operating and non-operating positions of the stop member. To remove and replace the stop member 7, the carriage 9 is disengagable from the positioning block 11′ by moving the portion 30 against the bias of the spring 28 sufficient for the projection 27 to clear the recess 26 and then moving the carriage 9 along the chamber 25 to the position 11 at which the projecting cam follower portions 8 of the stop member 7 can be released and replaced from the carriage 9 and associated roller. The carriage 9 can then be shifted back into position I with the recess 26 and projection 27 engagement fixing the carriage 9 and supported stop member in proper position without having to readjust the position of the positioning block 11′.

In FIGS. 9–12, a fourth preferred embodiment of the apparatus of the present invention is illustrated and includes a carriage 9 having a body portion 41 defining a slot, a means for reciprocating the carriage 9 including a reciprocating shaft 10 and a block 11″ for releasably positioning the carriage 9 on the reciprocating shaft 10 in a predetermined position. The positioning block 11″ includes a body portion 32 defining a slot, a through bore having a square cross-sectional configuration for receipt therein of the reciprocable shaft 10 and a set screw for adjustably securing the positioning block 11″ to the shaft 10. The carriage 9 and the positioning block 11″ are each movably received in the slot of the other, the slots being oppositely overlapping and permitting and guiding relative movement of the carriage from its predetermined position at which the stop member 7 is supported for reciprocation between its operating and non-operating positions. A spring 31 extends from the base 32 of the slot of the body portion of the positioning block 11″ to the opposed base of the slot of the body portion 41 of the carriage 9 to bias the carriage 9 against the positioning block 11″ and thereby retain the carriage 9 in proper position.

To release the stop member 7 from the carriage 9, the carriage 9 is shifted downwardly against the bias of the spring 31 sufficiently to permit the projecting cam follower portions 8 to be released from the carriage 9. Upon release of the carriage 9 it returns to its original predetermined position.

In FIG. 13, a fifth preferred embodiment of the apparatus of the present invention is illustrated and includes a carriage 9 having a magnet 33, means for reciprocating the carriage 9 including a reciprocable shaft 10 and a set screw for releasably positioning the carriage 9 on the reciprocable shaft 10 in a predetermined position. A magnetic positioning block 11 includes a recess for receiving a compatibly configured projection of the magnet 33 of the carriage 9. The magnetic attraction between the magnet 33 and the positioning block 11 urges the carriage 9 into engagement with the positioning block 11 in the predetermined position of the carriage. To release the stop member 7 from the carriage 9, the carriage 9 is moved against the urging of the magnetic attraction until the projection of the magnet 33 clears the recess of the positioning means 11. Then, the carriage 9 is moved along the reciprocable shaft 10 until the projecting cam follower portions 8 are released from the carriage 9 and associated roller. The carriage can them be returned to its predetermined position by shifting back into alignment of the recess and projection.

In FIGS. 14 and 15, a sixth preferred embodiment of the apparatus of the present invention is illustrated and includes a carriage 9″ having a cam portion for removably receiving and manipulating the projecting cam follower portion 8 of the stop member 7, means for reciprocating the carriage 9″ including a rotatable shaft 10 and a block 11‴ for positioning the carriage 9″ in a predetermined position I. The carriage 9″ is cylindrical and the cam portion thereof is in the form of a slot 34 on the surface of the cylindrical carriage 9″ extending as a portion of a spiral.

The positioning block 11‴ is mounted on the shaft 10 and secured in a predetermined fixed position by a set screw 40. The block 11‴ includes an axially extending projection 37 which is receivable in a compatibly configured slot of the carriage 9″ . Thereby, oscillation of the shaft 10 causes, through the projection and slot engagement, oscillation of the carriage 9″ about its cylindrical axis to cause the spiral slot 34 to cam the stop member 7 between its operating and non-operating positions. Additionally, the positioning block 11‴ includes a shaft portion on which the carriage 9″ is axially slidable, a central through bore for receiving the rotatable shaft 10 therein, and an end shoulder 35. A spring 36 extends between the shoulder 35 and the carriage 9″ to bias the carriage 9″ into engagement with the positioning block 11‴. The carriage 9″ includes an axial bore for receiving the shaft portion 35 therein and the carriage is axially movable along the shaft portion sufficiently to permit removal and replacement of the stop member 7 from the carriage 9'' and associated roller. To release the stop member 7 from the carriage 9'', the carriage is axially moved against the bias of the spring 36 and is oscillated until the projecting cam follower portion 8 is released from the slot 34. Release of the carriage 9'' then allows it to return into engagement with the positioning block 11''' and rotational alignment of the projection 37 and compatible recess results in the carriage 9'' assuming its original predetermined position.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. Apparatus for supporting a stop member of a stop motion device of a textile ring spinning machine, the stop member being of the type having a leading tapered end insertable between a drive roller and an opposed driven roller of a drafting device of the ring spinning machine to stop the rotation of the driven roller and the feed of roving through the drafting device and having a projecting cam follower portion, comprising:

a carriage having a cam portion for removably receiving and manipulating the projecting cam follower portion of the stop member;

means for reciprocating said carriage between an operating position in which the stop member is in a roller and roving stopping position and a non-operating position in which the stop member is retracted from said stopping position; and means for releasably positioning said carriage on said reciprocating means in a predetermined position, said carriage being disengagable from said positioning means for movement therefrom sufficiently to permit removal and replacement of said stop member from said carriage and being reengagable with said positioning means for positioning said carriage in said predetermined position.

2. Apparatus for supporting a stop member according to claim 1 and characterized further in that said carriage includes means for releasably engaging said positioning means to position said carriage in said predetermined position.

3. Apparatus for supporting a stop member according to claim 2 and characterized further in that said carriage and said positioning means each includes cooperatively configured portions for releasable interengagement with one another to position said carriage in said predetermined position.

4. Apparatus for supporting a stop member according to claim 3 and characterized further in that one of said carriage and said positioning means includes a projection and the other of said carriage and said positioning means includes a recess engagable with said projection for positioning said carriage in said predetermined position.

5. Apparatus for supporting a stop member according to claim 4 and characterized further in that said positioning means includes said projection and said carriage includes said recess.

6. Apparatus for supporting a stop member according to claim 5 and characterized further in that said carriage includes said projection and said positioning means includes said recess.

7. Apparatus for supporting a stop member according to claim 5 or 6 and characterized further in that said carriage includes biasing means for releasably retaining said carriage in engagement with said positioning means.

8. Apparatus for supporting a stop member according to claim 7 and characterized further in that said projection and said recess are disposed on one side of said positioning means and said biasing means is disposed on an opposite side of said positioning means.

9. Apparatus for supporting a stop member according to claim 8 and characterized further in that said biasing means includes a plate adjacent said positioning means and a spring disposed between said plate and said carriage for biasing said plate toward said positioning means.

10. Apparatus for supporting a stop member according to claim 5 and characterized further in that said positioning means includes means for positioning said carriage at a position spaced from said predetermined position sufficient to permit removal and replacement of said stop member.

11. Apparatus for supporting a stop member according to claim 5 and characterized further in that said positioning means is adjustable to vary said predetermined position of said carriage.

12. Apparatus for supporting a stop member according to claim 11 and characterized further in that said reciprocating means includes a reciprocable shaft, said positioning means being securable to said shaft for reciprocation therewith.

13. Apparatus for supporting a stop member according to claim 12 and characterized further in that said positioning means is adjustably secured to said shaft.

14. Apparatus for supporting a stop member according to claim 5 and characterized further in that said positioning means includes means engagable with said carriage to prevent separation of said carriage from said positioning means.

15. Apparatus for supporting a stop member according to claim 3, 4 or 5 and characterized further in that said reciprocating means includes a reciprocable shaft and a shaft support, said shaft being adjustably fixed to said shaft support for adjustably setting the predetermined positions of said positioning means, and said positioning means being integrally formed on said shaft.

16. Apparatus for supporting a stop member according to claim 3, 4 or 5 and characterized further in that said carriage and positioning means includes magnetic means for urging said carriage into engagement with said positioning means in said predetermined position.

17. Apparatus for supporting a stop member according to claim 3 and characterized further in that one of said carriage and said positioning means includes a slot and the other of said carriage and said positioning means includes a portion receivable in said slot to permit and guide relative movement of said carriage from said predetermined position.

18. Apparatus for supporting a stop member according to claim 17 and characterized further in that said carriage and said positioning means each include a slot and said carriage and said positioning means are each movably received in the slot of the other.

19. Apparatus for supporting a stop member according to claim 18 and characterized further in that said carriage includes biasing means for releasably retaining said carriage in engagement with said positioning means.

20. Apparatus for supporting a stop member according to claim 18 and characterized further in that said positioning means is adjustable to vary said predetermined position of said carriage.

21. Apparatus for supporting a stop member according to claim 3 and characterized further in that said carriage is cylindrical and said cam portion is in the form of a slot on the surface of said cylindrical carriage extending as a portion of a spiral, and said carriage being oscillatable about its cylindrical axis to effect movement of said stop member between operating and non-operating positions.

22. Apparatus for supporting a stop member according to claim 21 and characterized further in that said carriage is axially movable sufficiently to permit removal and replacement of said stop member from said carriage.

23. Apparatus for supporting a stop member according to claim 21 and characterized further in that said positioning means includes a shaft portion and said carriage includes an axial bore for receiving said shaft portion therein, said carriage being axially movable along said shaft portion sufficiently to permit removal and replacement of said stop member from said carriage.

24. Apparatus for supporting a stop member according to claim 23 and characterized further by biasing means for releasably retaining said carriage in engagement with said positioning means.

* * * * *